US006072973A

United States Patent [19]

Park

[11] Patent Number: 6,072,973

[45] Date of Patent: Jun. 6, 2000

[54] SQUEEZE ROLLER ELEVATING APPARATUS FOR LIQUID ELECTROPHOTOGRAPHIC PRINTER

[75] Inventor: Woo-yong Park, Suwon, Rep. of Korea

[73] Assignee: Samsung Electronics Co., Ltd., Kyungki-Do, Rep. of Korea

[21] Appl. No.: 09/307,030

[22] Filed: May 7, 1999

[30] Foreign Application Priority Data

May 8, 1998 [KR] Rep. of Korea ..... 98-16506

[51] Int. Cl.[7] ..... G03G 15/10; G03G 21/00

[52] U.S. Cl. ..... 399/249; 399/348

[58] Field of Search ..... 399/249, 348, 399/237

[56] References Cited

U.S. PATENT DOCUMENTS 5,432,591 7/1995 Geleynse ..... 399/249
5,481,341 1/1996 Sypula et al. ..... 399/249 X
5,521,685 5/1996 Barnes et al. ..... 399/249
5,913,096 6/1999 Park ..... 399/237

*Primary Examiner*—Susan S. Y. Lee
*Attorney, Agent, or Firm*—Sughrue, Mion, Zinn, Macpeak & Seas, PLLC

[57] ABSTRACT

A squeeze roller elevating apparatus for a liquid electrophotographic printer in which a squeeze roller selectively presses a photoreceptor belt, the photoreceptor belt being supported by a belt, the apparatus including a squeeze frame fixed to the belt frame to support the squeeze roller, the squeeze roller being capable of elevating, and an elevating mechanism for elevating the squeeze roller. The elevating mechanism includes a driving motor, a winch drum being rotated by the driving motor, a mobile pulley rotatably installed at one end portion of a rotation shaft of the squeeze roller, and a wire having one end thereof fixed to the squeeze frame and the other end thereof wound about the winch drum, to support the mobile pulley, wherein, when the winch drum is rotated by the driving motor, the wire is wound or released so that the mobile pulley and the squeeze roller ascend or descend, respectively.

3 Claims, 5 Drawing Sheets

SQUEEZE ROLLER ELEVATING APPARATUS FOR LIQUID ELECTROPHOTOGRAPHIC PRINTER

The present invention relates to a squeeze roller elevating apparatus for a liquid electrophotographic printer.

BACKGROUND OF THE INVENTION

A developing unit for developing an electrostatic latent image formed on a photoreceptor belt is provided in a liquid electrophotographic printer. The developing unit, as shown in FIG. 1, includes a developing roller 13 for developing an electrostatic latent image by supplying a developer 1, which is a mixture of powdered toner and a liquid carrier, to the photoreceptor belt, and a squeeze roller 11 for removing excess developer from the photoreceptor belt 10.

The squeeze roller 11 presses the photoreceptor belt 10 against a backup roller 12 during printing to remove the excess developer. After printing, the squeeze roller 11 is separated from the photoreceptor belt 10 and the pressing force is removed.

To perform the above operation, a squeeze roller elevating apparatus is provided in a liquid electrophotographic printer so that the squeeze roller 11 is separated from the photoreceptor belt 10 when no printing is performed, and is elevated and pressed against the photoreceptor belt 10 during printing.

The structure of a conventional squeeze roller elevating apparatus is shown in FIG. 2. A squeeze frame 20 having a squeeze roller 11 is installed at a main frame 40 to be capable of elevating. The squeeze frame 20 is elevated by a cam 22 rotated by a driving motor (not shown) and thus, the squeeze roller 11 can be elevated. Reference numeral 30 refers to a belt frame which supports the photoreceptor belt 10 so as to not deviate from a regular circulation path.

In the squeeze roller elevating apparatus, since the squeeze frame 20 must be elevated to elevate the squeeze roller 11, an extra space is required for the elevation thereof. Also, a large driving force is needed to elevate the squeeze frame 20.

SUMMARY OF THE INVENTION

To solve the above problems, it is an objective of the present invention to provide a squeeze roller elevating apparatus for a liquid developer having an improved structure so that the elevation of a squeeze roller can be performed with a smaller force in a small space.

Accordingly, to achieve the above objective, there is provided a squeeze roller elevating apparatus for a liquid electrophotographic printer in which a squeeze roller selectively presses a photoreceptor belt, the photoreceptor belt being supported by a belt frame, the apparatus including: a squeeze frame fixed to the belt frame to support the squeeze roller, the squeeze roller being capable of elevating; and means for elevating said squeeze roller.

It is preferred in the present invention that the elevating means includes: a driving motor; a winch drum being rotated by the driving motor; a mobile pulley rotatably installed at one end portion of a rotation shaft of the squeeze roller; and a wire having one end thereof fixed to the squeeze frame and the other end thereof wound about the winch drum, to support the mobile pulley, wherein, when the winch drum is rotated by the driving motor, the wire is wound or released so that the mobile pulley and the squeeze roller ascend or descend, respectively.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE PREFERRED EMBODIMENTS

Figure 1:
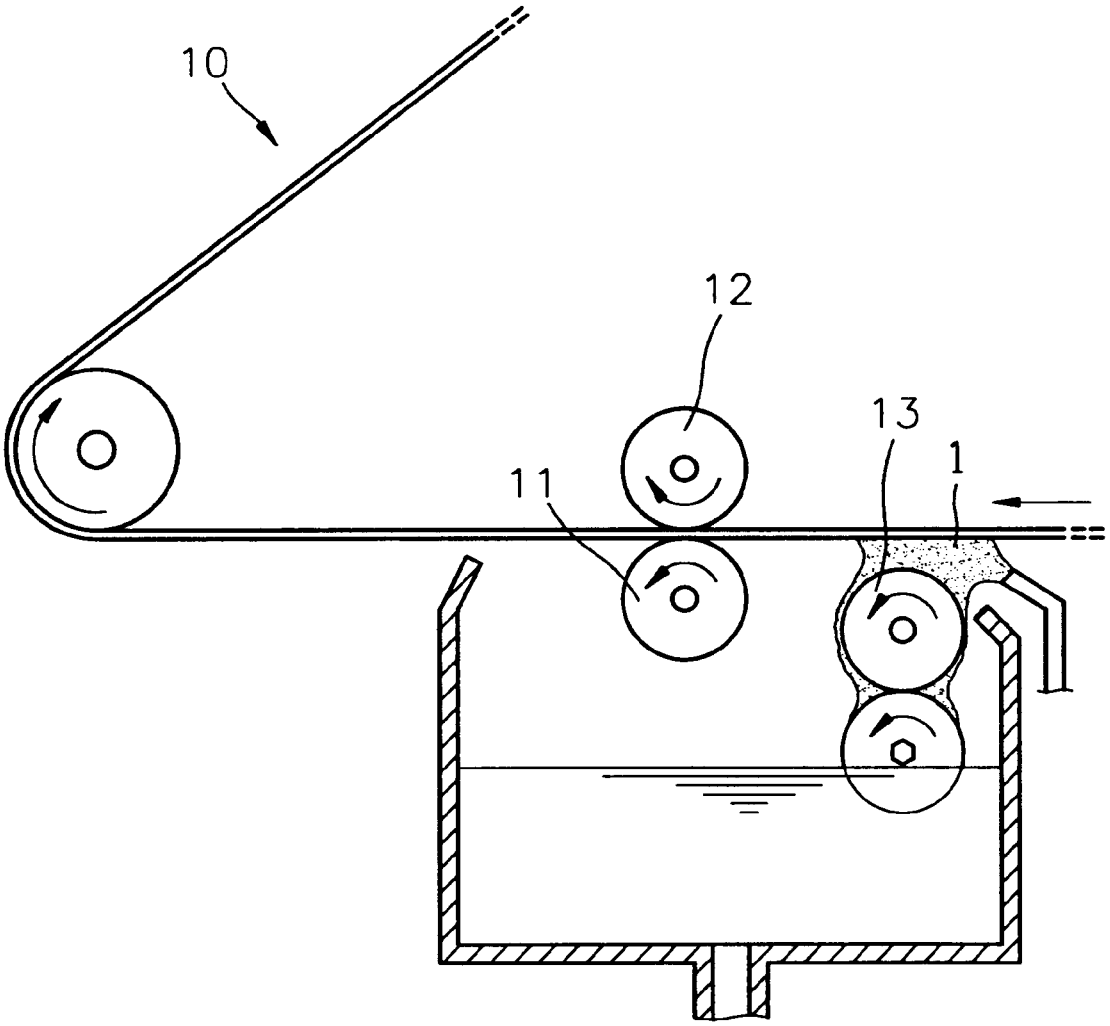
FIG. 1 (PRIOR ART)
FIG. 1 is a schematic view showing a developing unit of a general liquid electrophotographic printer.
Figure 2:
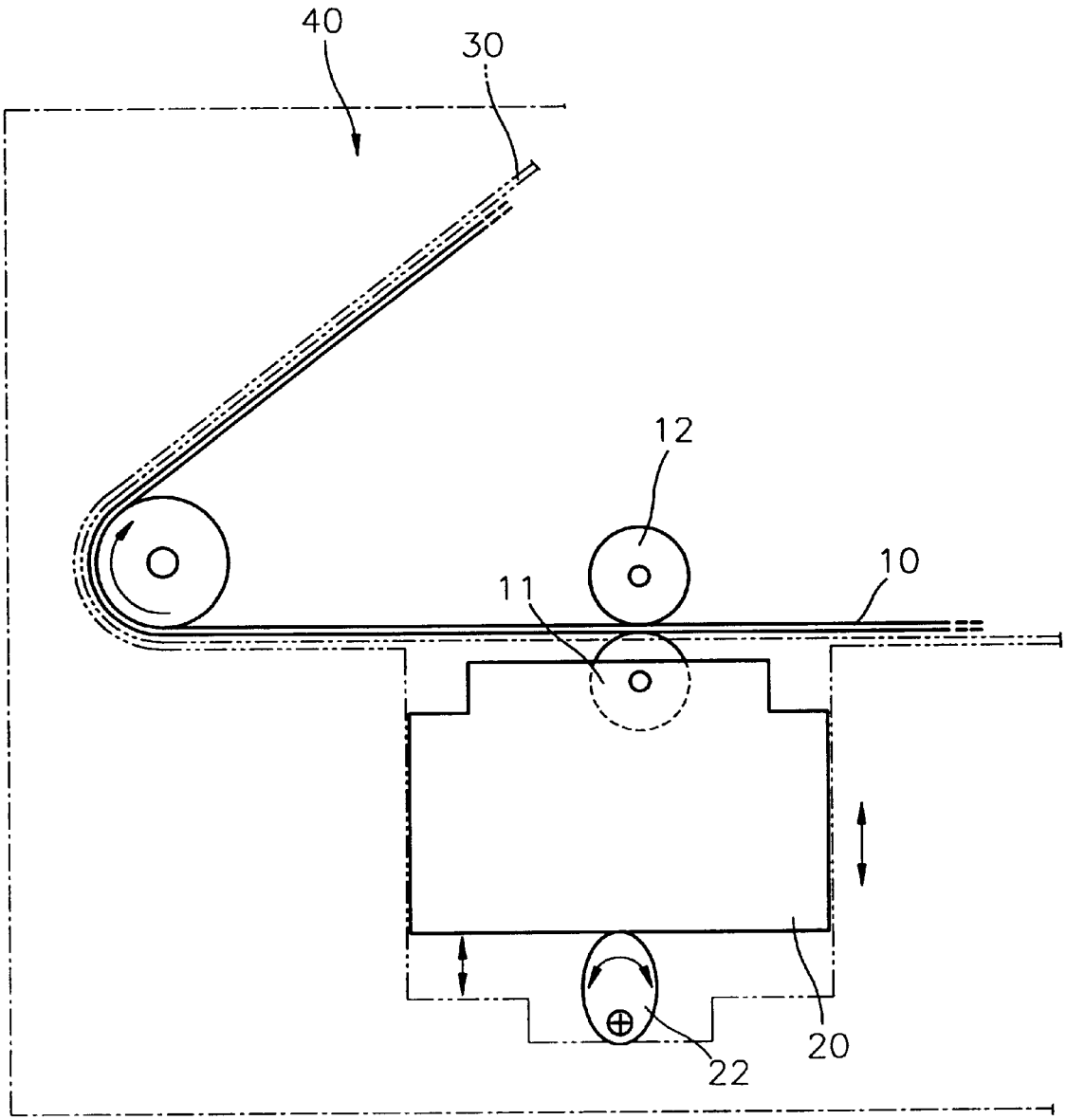
FIG. 2 (PRIOR ART)
FIG. 2 is a schematic view showing a conventional squeeze roller elevating apparatus.
Figure 3:
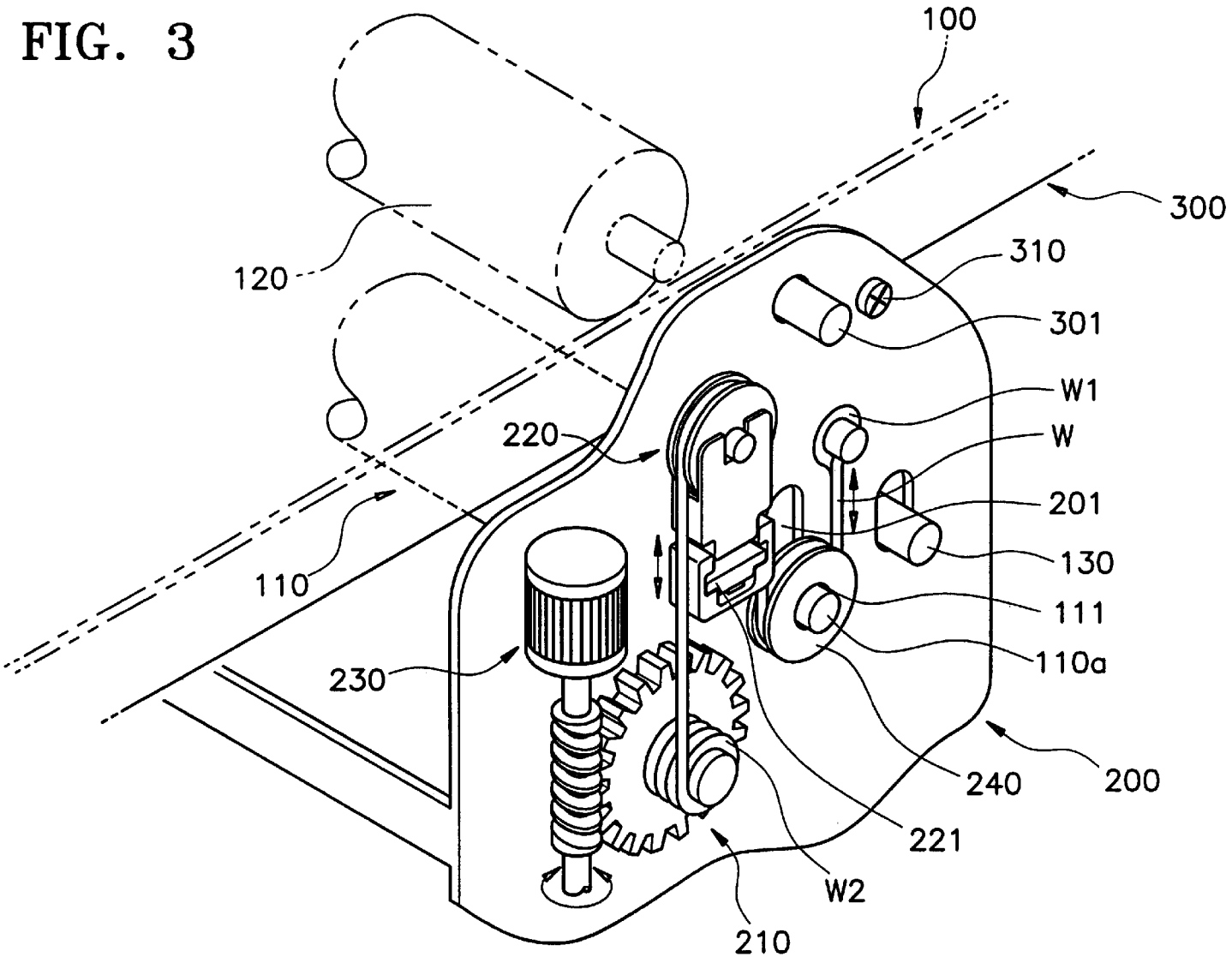
FIG. 3 is a perspective view showing a squeeze roller elevating apparatus according to the present invention.
Figure 4:
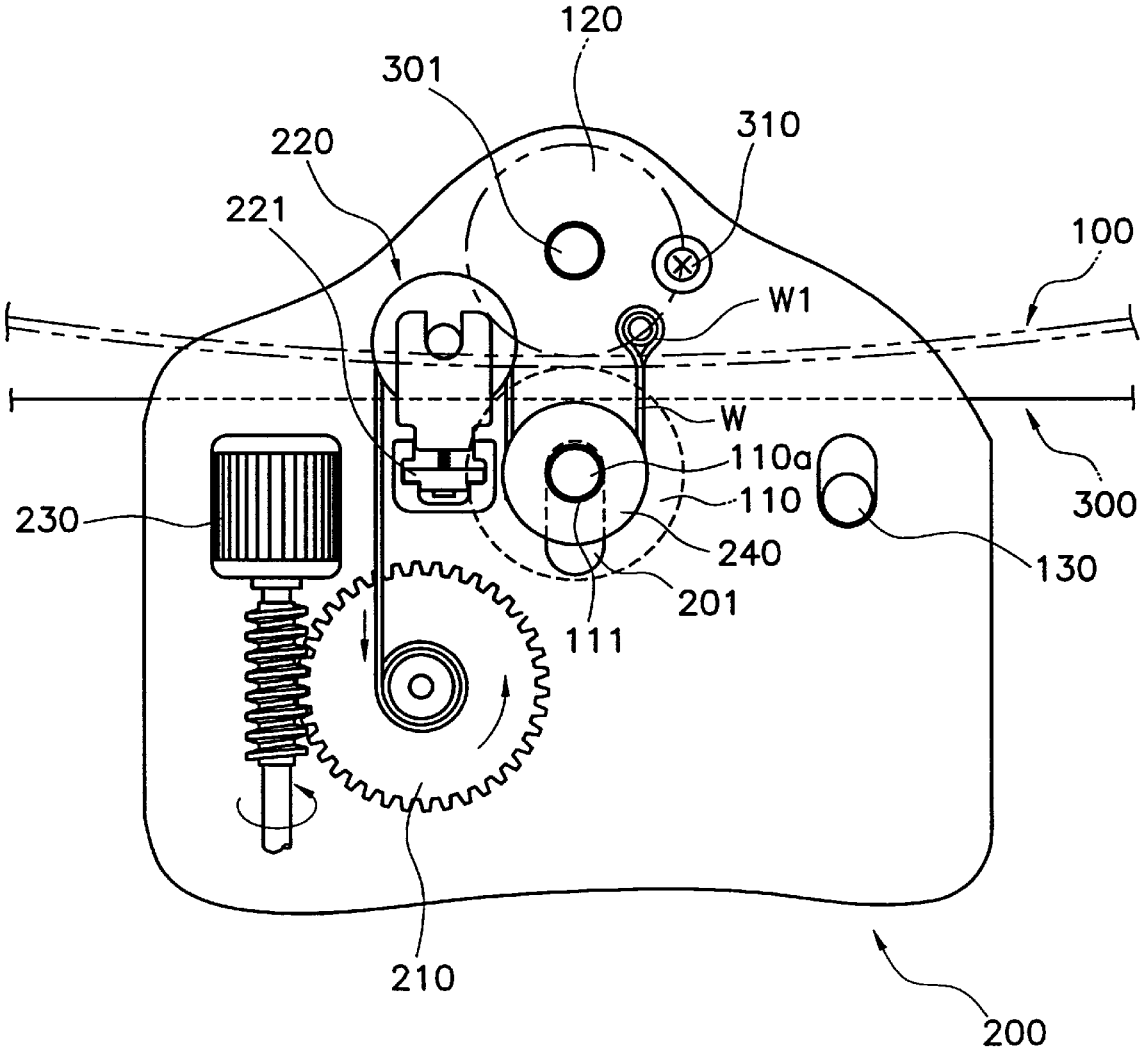
FIGS. 4 and 5 are views for explaining the operation of the squeeze roller elevating apparatus shown in FIG. 3.

Referring to FIGS. 3 and 4, a belt frame 300 for supporting a photoreceptor belt 100 so as to not deviate from a regular circulating path, is provided. A squeeze frame 200 for supporting the squeeze roller 110 is fixed to the belt frame 300. That is, a coupling protrusion 301 formed on the belt frame 300 is inserted into a hole formed in the squeeze frame 200 and the squeeze frame 200 is coupled to the belt frame 300 by a screw 310.

An elevating means for lifting the squeeze roller 110 toward a backup roller 120 installed at the belt frame 300 and pressing the squeeze roller 110 against the photoreceptor belt 100, is provided at the squeeze frame 200. The elevating means includes a mobile pulley 240 coupled by bearings 111 at an end portion of a rotation shaft 110*a* of the squeeze roller 110, a winch drum 210 installed to be capable of being rotated by a driving motor 230, and a fixed pulley 220 fixed at the squeeze frame 200. The rotation shaft 110*a* moves up and down along a slot 201 formed at the squeeze frame 200. A wire W having one end W1 thereof being fixed to the squeeze frame 200 is wound about the winch drum 210 at the other end W2 thereof via the mobile pulley 240 and the fixed pulley 220. Thus, the mobile pulley 240 is supported by the wire W of which the one end W1 is fixed and which is supported by the fixed pulley 220. Reference numeral 221 indicates a sensor for detecting the load applied to the fixed pulley 220 by the wire W; and reference numeral 130 indicates a shaft of a developing roller (not shown).

The operation of the squeeze roller elevating apparatus having the above structure is as follows. During printing, as shown in FIG. 4, the wire W is wound by rotating the winch drum 210 counterclockwise by the driving motor 230. Accordingly, since the one end W1 of the wire W is fixed, the mobile pulley 240 supported between the one end W1 of the wire W and the fixed pulley 220 ascends. Thus, the squeeze roller 110 ascends and presses the photoreceptor belt 100 against the backup roller 120.

Here, the squeeze roller 110 ascends as the mobile pulley 240 rotates. Thus, according to the principle of a mobile pulley mechanism, the squeeze roller 110 can be lifted with only half the force than directly lifting the squeeze roller 110.

Figure 5:
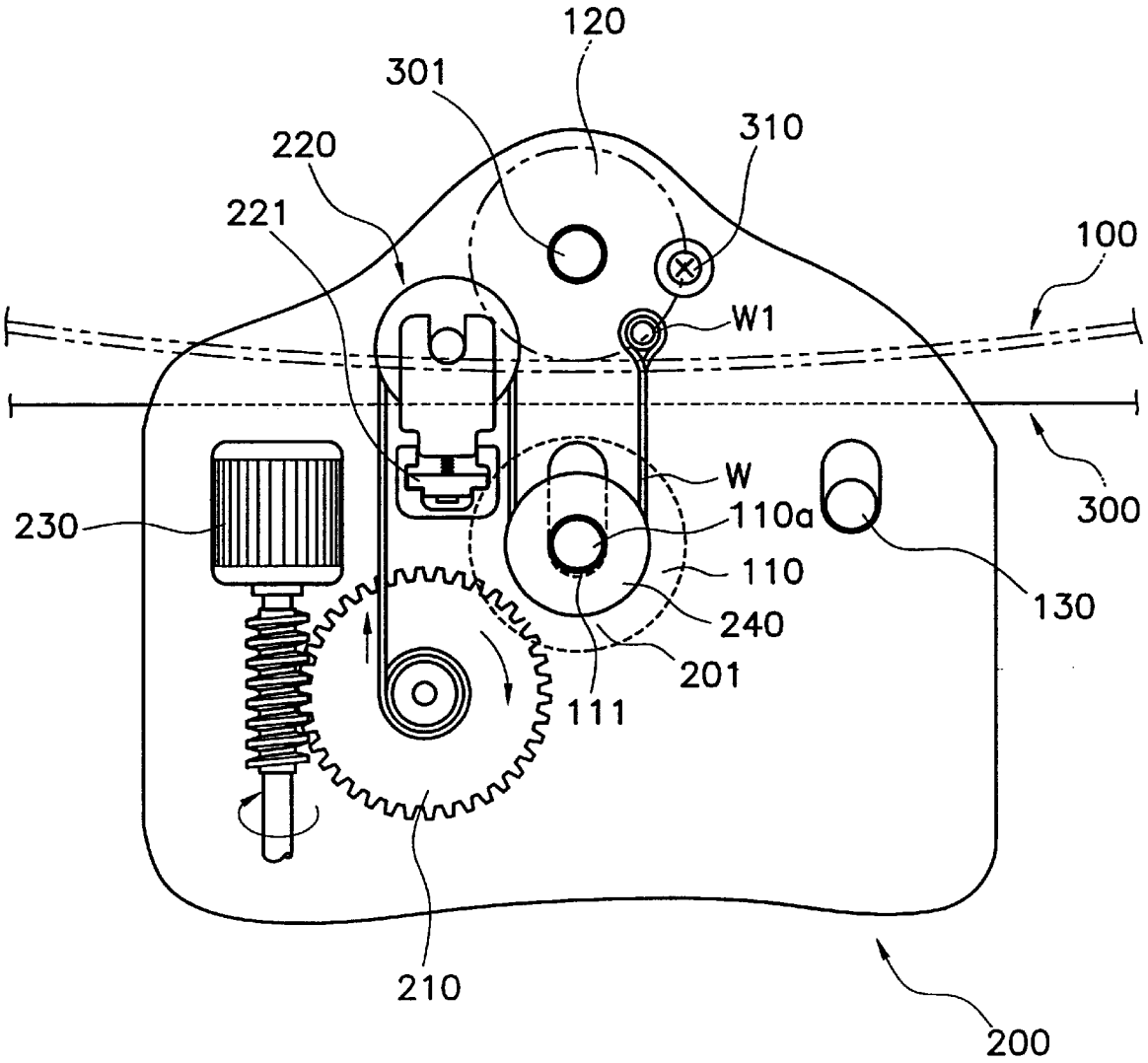

Next, when printing is completed and the squeeze roller 110 is separated from the photoreceptor belt 100, as shown in FIG. 5, the wire W is released by rotating the winch drum 210 clockwise by the driving motor 230. Accordingly, the mobile pulley 240 and the squeeze roller 110 descend due to the weights thereof.

As described above, according to the squeeze roller elevating apparatus according to the present invention, the squeeze roller can be lifted with relatively less force. Also, since the squeeze roller only ascends when the squeeze frame is fixed to the belt frame, extra space needed for the elevating movement can be considerably reduced.

It is contemplated that numerous modifications may be made to the apparatus and procedure of the invention without departing from the spirit and scope of the invention as defined in the following claims.

What is claimed is:

1. A squeeze roller elevating apparatus for a liquid electrophotographic printer in which a squeeze roller selectively presses a photoreceptor belt which is supported by a belt frame, said apparatus comprising:

a squeeze frame fixed to said belt frame to support said squeeze roller, said squeeze roller being capable of elevating; and means for elevating said squeeze roller;

wherein said elevating means comprises:

a driving motor;

a winch drum being rotated by said driving motor;

a mobile pulley rotatably installed at one end portion of a rotation shaft of said squeeze roller; and a wire having one end thereof fixed to said squeeze frame and the other end thereof wound about said winch drum, to support said mobile pulley, wherein when said winch drum is rotated by said driving motor, said wire is one of wound and released so that said mobile pulley and said squeeze roller one of ascend and descend, respectively.

2. The apparatus as claimed in claim 1, wherein said elevating means further comprises a fixed pulley for supporting said wire installed at said squeeze frame between said winch drum and mobile pulley to support said mobile pulley.

3. A squeeze roller elevating apparatus for a liquid electrophotographic printer in which a squeeze roller selectively presses a photoreceptor belt which is supported by a belt frame, said apparatus comprising:

a squeeze frame fixed to said belt frame to support said squeeze roller, said squeeze roller being capable of elevating;

a winch drum supported on said squeeze frame, around which a wire is wound;

a mobile pulley rotatably installed at one end portion of a rotation shaft of said squeeze roller, and which winds the wire around said winch drum, causing said squeeze roller to elevate;

means for driving said mobile pulley and said winch drum.

* * * * *